US007902763B2

(12) United States Patent
Wei et al.

(10) Patent No.: US 7,902,763 B2
(45) Date of Patent: Mar. 8, 2011

(54) PIEZOELECTRIC CASCADE RESONANT LAMP-IGNITION CIRCUIT

(75) Inventors: Tao-Chin Wei, Taipei (TW); Ming Shing Chou, Taoyuan (TW); Hsi Chen Chang, Tucheng (TW)

(73) Assignees: Midas Wei Trading Co., Ltd., Taipei (TW); Champion Elite Company Limited, Tortola (VG)

( * ) Notice: Subject to any disclaimer, the term of this patent is extended or adjusted under 35 U.S.C. 154(b) by 400 days.

(21) Appl. No.: 12/255,364

(22) Filed: Oct. 21, 2008

(65) Prior Publication Data

US 2009/0174336 A1 Jul. 9, 2009

Related U.S. Application Data

(63) Continuation-in-part of application No. 12/025,852, filed on Feb. 5, 2008, now Pat. No. 7,683,554.

(30) Foreign Application Priority Data

Jan. 7, 2008 (TW) ..... 97100566 A
Sep. 9, 2008 (TW) ..... 97134533 A

(51) Int. Cl.
*H05B 41/00* (2006.01)

(52) U.S. Cl. ..... 315/209 PZ; 315/244; 315/318

(58) Field of Classification Search ..... 315/209 PZ, 315/307, 308, 318, 239, 244
See application file for complete search history.

(56) References Cited

U.S. PATENT DOCUMENTS

| | | | | |
|---|---|---|---|---|
| 5,886,477 | A * | 3/1999 | Honbo et al. | 315/209 PZ |
| 7,436,130 | B2 * | 10/2008 | Komatsu et al. | 315/307 |
| 2004/0195936 | A1 * | 10/2004 | Chemisky et al. | 310/317 |
| 2008/0174251 | A1 * | 7/2008 | Chen et al. | 315/219 |
| 2009/0039800 | A1 * | 2/2009 | Kimura | 315/307 |

* cited by examiner

*Primary Examiner* — Don P Le
(74) *Attorney, Agent, or Firm* — Ming Chow; Sinorica, LLC

(57) ABSTRACT

The present invention discloses a piezoelectric cascade resonant lamp-ignition circuit, which uses the intrinsic capacitors of a piezoelectric transformer as piezoelectric capacitors. One lamp is cascaded to one set of the piezoelectric capacitors. Several sets of the piezoelectric capacitors and a resonant inductor are cascaded to form a resonant lamp-ignition circuit. The lamp-ignition circuit of the present invention has advantages of low temperature, small leakage current, high breakdown voltage and high lamp ignition efficiency. When applied to drive several lamps, the present invention uses a fixed frequency to attain a fixed inner impedance of the equivalent circuit of the piezoelectric capacitor. Thereby, the currents of the lamps are balanced to have an identical value.

9 Claims, 10 Drawing Sheets

PIEZOELECTRIC CASCADE RESONANT LAMP-IGNITION CIRCUIT

The present invention is a continuous-in-part application of the application that is entitled "HIGH-VOLTAGE LAMP-IGNITION PIEZOELECTRIC OSCILLATOR" (U.S. application Ser. No. 12/025,852) filed Feb. 5, 2008 now U.S. Pat. No. 7,683,554, which is filed presently with the U.S. Patent & Trademark Office, and which is used herein for reference in its entirety.

BACKGROUND OF THE INVENTION

1. Field of the Invention

The present invention relates to a cascade resonant lamp-ignition circuit, particularly to a piezoelectric cascade resonant lamp-ignition circuit formed via cascading several sets of piezoelectric capacitors to an independent inductor.

2. Description of the Related Art

The principle of CCFL (Cold Cathode Fluorescent Lamp) is similar to that of the daylight lamp. When a high voltage is input to the electrodes, few electrons impact the electrode at high speed to generate secondary electrons. Then, discharge begins, and electrons collide with mercury atoms, and the mercury atoms radiate ultraviolet ray with a wavelength of 253.7 nm Then, the ultraviolet ray excites the fluorescent powder on the inner tube wall to emit visible light with the correlated color temperature. In addition to be used in display devices, PDA, digital cameras, mobile phones, etc., CCFL is also an indispensable element for backlight modules.

With the increasing size of LCD, the number of CCFL of the backlight unit is also increased to maintain the same brightness or even acquire a higher brightness. To achieve brightness uniformity and a long service life, the currents of lamps and the difference of currents should be strictly controlled. In a conventional multi-lamp module, the lamps connect with a traditional coil-type step-up transformer. However, the traditional coil-type step-up transformer has low efficiency and low breakdown voltage. Therefore, the traditional coil-type step-up transformer is an unsafe device because it is likely to be punctured by a high voltage and burned down. Refer to FIG. 1 for another multi-lamp module. The difference of currents is compensated by the capacitor 110 cascaded to the high-voltage end of the lamp 100. However, such a design has low efficiency and great leakage current. Further, the capacitor 110 has low breakdown voltage and may explode and cause a fire.

SUMMARY OF THE INVENTION

The primary objective of the present invention is to provide a piezoelectric cascade resonant lamp-ignition circuit, which uses the intrinsic capacitors of a piezoelectric transformer as piezoelectric capacitors, wherein several sets of the piezoelectric capacitors and a resonant inductor are cascaded to form a resonant lamp-ignition circuit, whereby the lamp-ignition circuit of the present invention has advantages of small leakage current, current balance and high lamp ignition efficiency.

Another objective of the present invention is to provide a piezoelectric cascade resonant lamp-ignition circuit, wherein a piezoelectric transformer replaces the capacitors of the traditional lamp-ignition circuits or the coil-type step-up transformers, whereby the present invention has small volume and outstanding electric performance, and whereby the present invention prevents from overheat and malfunction caused by low breakdown voltage, wherefore the present invention has high reliability and superior market competitiveness.

A further objective of the present invention is to provide a piezoelectric cascade resonant lamp-ignition circuit, which uses cascade connection to decrease wire length and reduce the final size of the product.

To achieve the abovementioned objectives, the present invention replaces the ballast and inverter of the conventional resonant lamp-ignition circuit with a piezoelectric capacitor, which is originally used as the high-power piezoelectric ceramic oscillation plate of the ultrasonic oscillator. The resonant lamp-ignition circuit of the present invention has a step-up ratio varying with the inner impedance of the load; therefore, the present invention is very suitable to drive lamps. When lamps have not lightened yet, the equivalent circuit is in an open-circuit state, and the resonant lamp-ignition circuit of the present invention supplies a very high step-up ratio to instantly ignite the lamps. When the lamps have lightened, the equivalent impedance and the step-up ratio both decrease, and the lamps operate in a steady state.

Further, the present invention balances the currents of a plurality of lamps. The present invention uses a fixed frequency to attain a fixed inner impedance of the equivalent circuit of the piezoelectric capacitor of a lamp and make a fixed current flow through the lamp. When the piezoelectric capacitors of the lamps have approximate electric performances, the piezoelectric capacitors also have approximate inner impedances, and the lamps have almost identical currents. Thus are balanced the currents of a plurality of lamps.

The present invention integrates several sets of piezoelectric capacitors and independent inductors to form a resonant lamp-ignition circuit. The embodiments of the present invention include a full-bridge double-high-voltage lamp-ignition architecture and a half-bridge single-high-voltage lamp-ignition architecture.

Below, the embodiments are described in detail in cooperation with the drawings to make easily understood the objectives, characteristics and functions of the present invention.

DETAILED DESCRIPTION OF THE INVENTION

Figure 1:
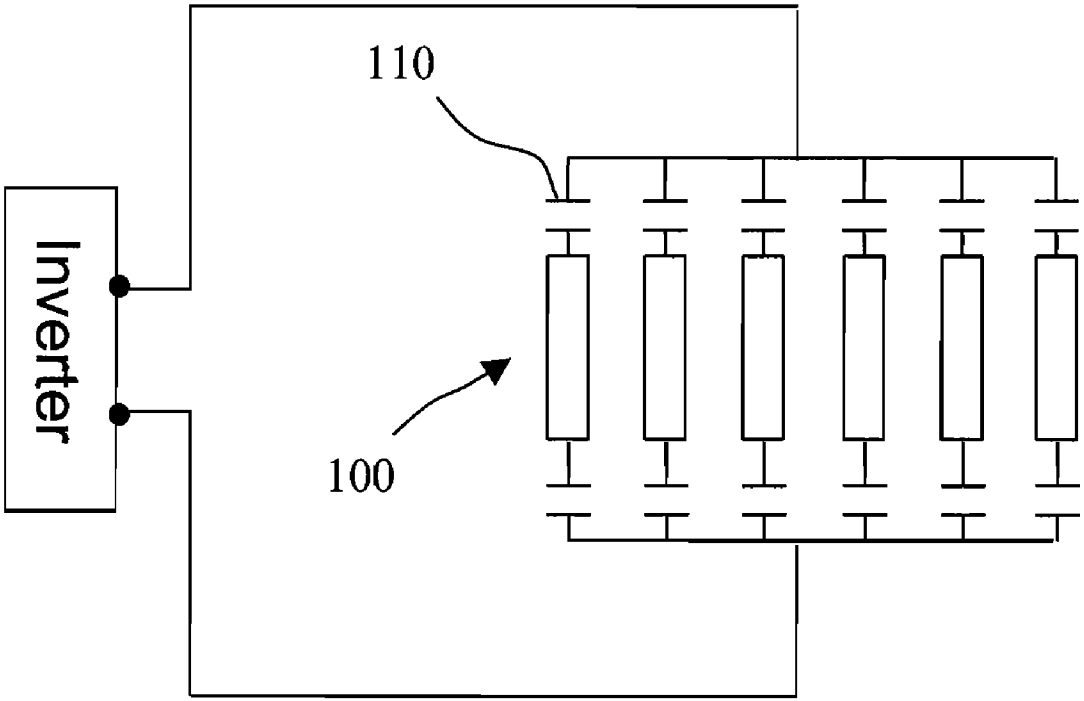
Fig.1 (Prior art)
FIG. 1 is a diagram schematically showing a multi-lamp module using conventional capacitors.
Figure 2:
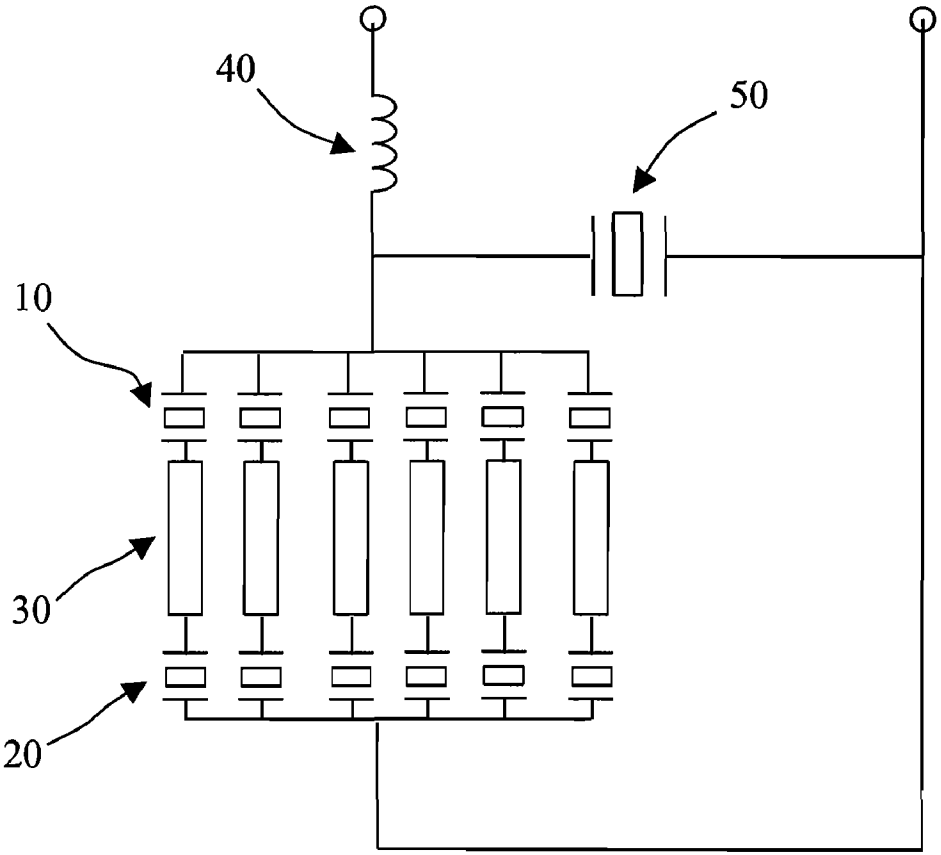
FIG. 2 is a diagram schematically showing a piezoelectric cascade resonant lamp-ignition circuit according to one embodiment of the present invention.

Refer to FIG. 2 a diagram schematically showing a piezoelectric cascade resonant lamp-ignition circuit according to one embodiment of the present invention. As shown in FIG. 2, the lamp-ignition circuit of the present invention comprises several sets of piezoelectric capacitors 10 and 20 and a resonant inductor 40. Each set of piezoelectric capacitors 10 and 20 are cascaded to a CCFL 30. All sets of piezoelectric capacitors 10 and 20 are parallel connected, and then all sets of piezoelectric capacitors 10 and 20 are totally cascaded to the resonant inductor 40. In the present invention, the intrinsic capacitors of the piezoelectric transformer function as the piezoelectric capacitors 10 and 20. The piezoelectric capacitors 10 and 20 and the resonant inductor 40 are cascaded to form a resonant lamp-ignition circuit containing an inductor and a piezoelectric transformer cascaded to each other. The resonant lamp-ignition circuit is boosted to ignite lamps by adjusting the resonant inductor 40 and the capacitance of the piezoelectric transformer.

Figure 3:
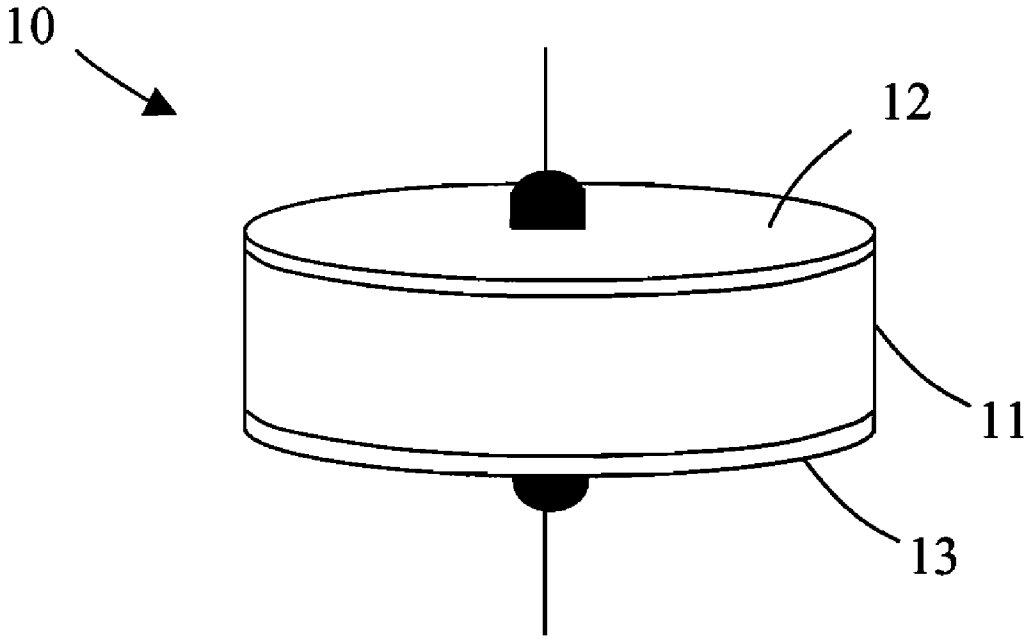
FIG. 3 is a diagram schematically showing the structure of a piezoelectric capacitor according to one embodiment of the present invention.
Figure 10:
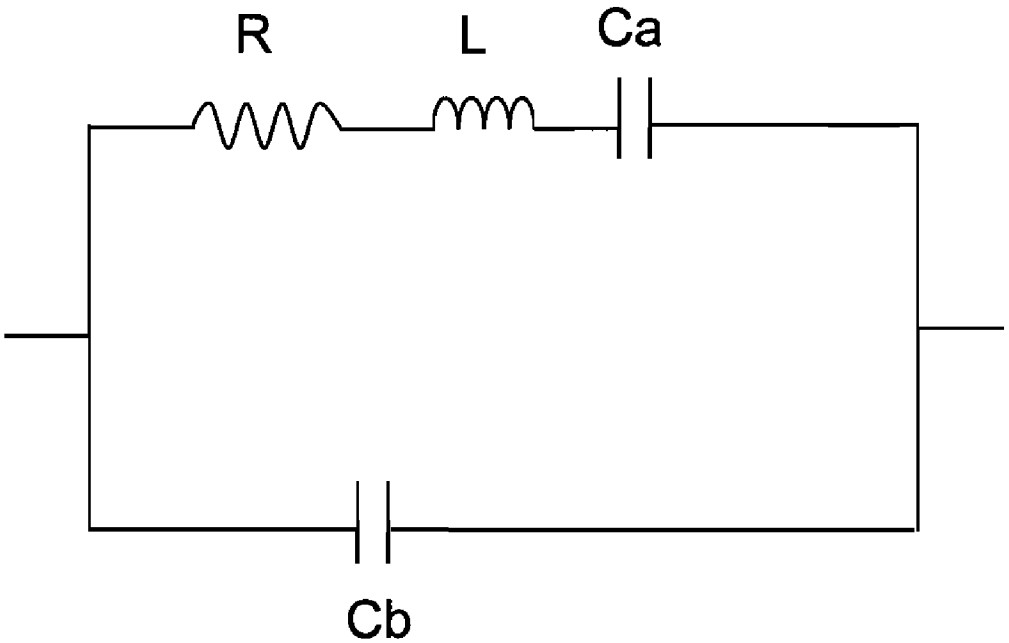
FIG. 10 is a diagram showing the equivalent circuit of a piezoelectric capacitor according to one embodiment of the present invention.

The piezoelectric capacitors 10 and 20 are structurally similar, and the piezoelectric capacitor 10 is used to exemplify them herein. Refer to FIG. 3. In the piezoelectric capacitor 10, a piezoelectric material is fabricated into a disc-shape piezoelectric substrate 11, and a conductive paste, such as a silver paste, a copper paste or a nickel paste, is applied onto the upper and lower surfaces of the piezoelectric substrate 11 to form electric conduction layers 12 and 13. The electric conduction layers 12 and 13 function as the electrodes of the piezoelectric capacitor 10 and conduct current. The piezoelectric substrate 11 and the electric conduction layers 12 and 13 may also be fabricated into a rectangular shape or a square shape. Refer to FIG. 10 for an equivalent circuit of the piezoelectric capacitor 10 or 20. The equivalent circuit contains an equivalent resistor R, an equivalent inductor L, and two equivalent capacitors Ca and Cb that respectively represent the mechanical and electric features. Distinct from the traditional capacitors or the coil-type step-up transformers, the piezoelectric capacitor 10 or 20 of the present invention has small leakage current and high breakdown voltage and thus is exempt from the danger of catching a fire. Therefore, the present invention is safe and reliable. The present invention increases the output power by several folds and obviously promotes the lamp-ignition efficiency. Further, the piezoelectric capacitors have a small volume and a small package thickness, and the piezoelectric capacitors, the resonant inductor and the lamps are connected in series. Thus, the final size of the product is reduced. Compared with a parallel connection design, the cascade connection design of the present invention keeps the circuit at a lower temperature and reduce loss.

The piezoelectric cascade resonant lamp-ignition circuit of the present invention effectively maintains the balance of lamp currents. When a DC pulse voltage is converted into an AC power to drive the circuit, the piezoelectric capacitor boosts a low voltage to such a high voltage that ignites the lamps. The variation of lamp impedances causes the non-uniformity of lamp currents and then results in uneven brightness and shorter lamp lives. When the present invention drives the resonant lamp-ignition circuit at a fixed frequency, the inner impedance of the equivalent circuit of the piezoelectric capacitor has a fixed value. Thus, a fixed current flows through the lamp. When the piezoelectric capacitors of the lamps have approximate electric performances, the piezoelectric capacitors also have approximate inner impedances, and the lamps have almost identical currents. Thus are balanced the currents of a plurality of lamps.

In this embodiment, an auxiliary piezoelectric capacitor 50 may be connected in parallel with the resonant inductor 40 and all the lamps 30 to form a cascade-parallel resonant lamp-ignition circuit. Thereby, in addition to igniting lamps, the present invention adjusts the capacitance to finely tune the output current and optimize the output power. At the moment of lamp ignition, the voltage rises abruptly. After lamps have been ignited, the inner impedance of the load decreases, and the step-up ratio also descends. Therefore, the present invention adjusts the output to reduce power consumption.

Figure 4:
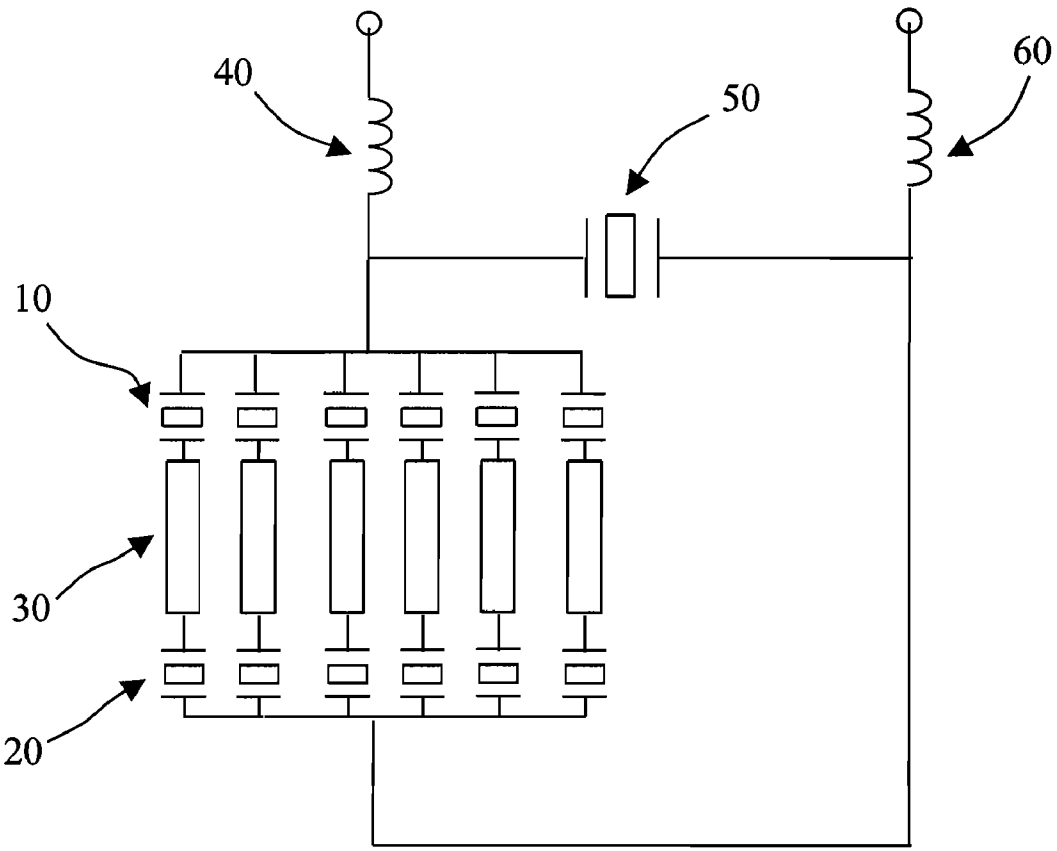
FIG. 4 is a diagram schematically showing a full-bridge piezoelectric cascade resonant lamp-ignition circuit according to one embodiment of the present invention.

In the abovementioned embodiment, two piezoelectric capacitors 10 and 20 for each lamp 30 and a single resonant inductor 40 for all the lamps 30 form a half-bridge resonant circuit, which reduces the cost of fabrication and promote the competitiveness of price. Refer to FIG. 4. Another resonant inductor 60 is added to the half-bridge resonant circuit to form a full-bridge resonant circuit, which outputs higher power.

Figure 5:
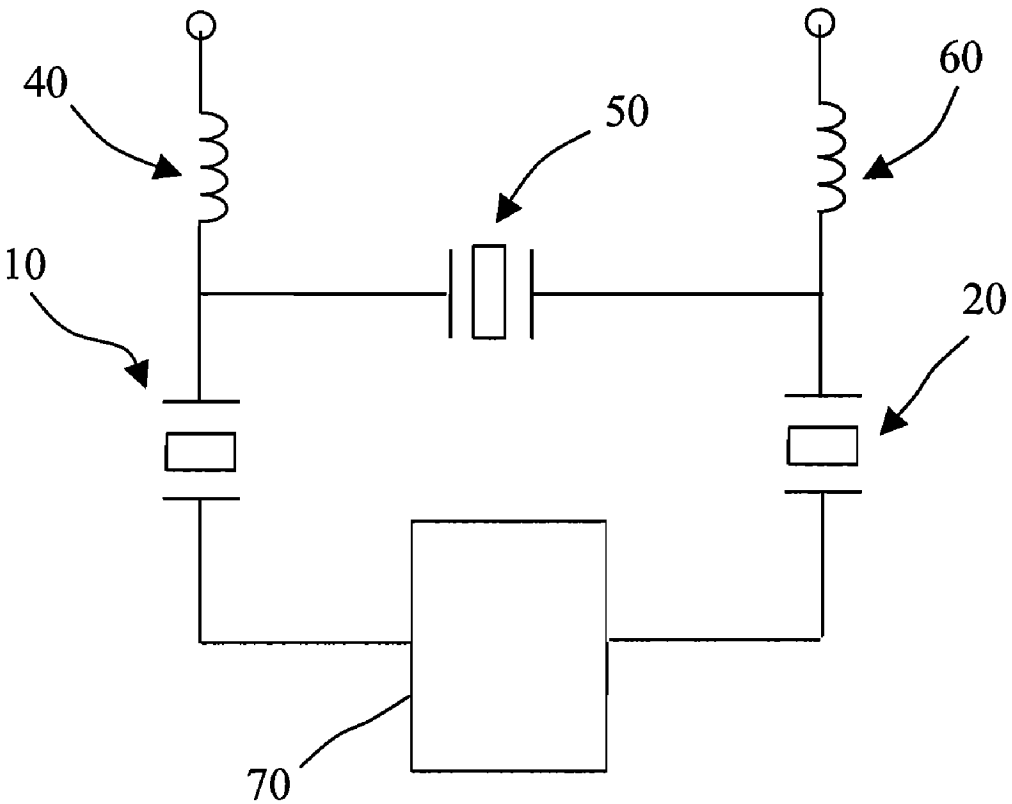
FIG. 5 is a diagram schematically showing the application of the present invention to EEFL.
Figure 6:
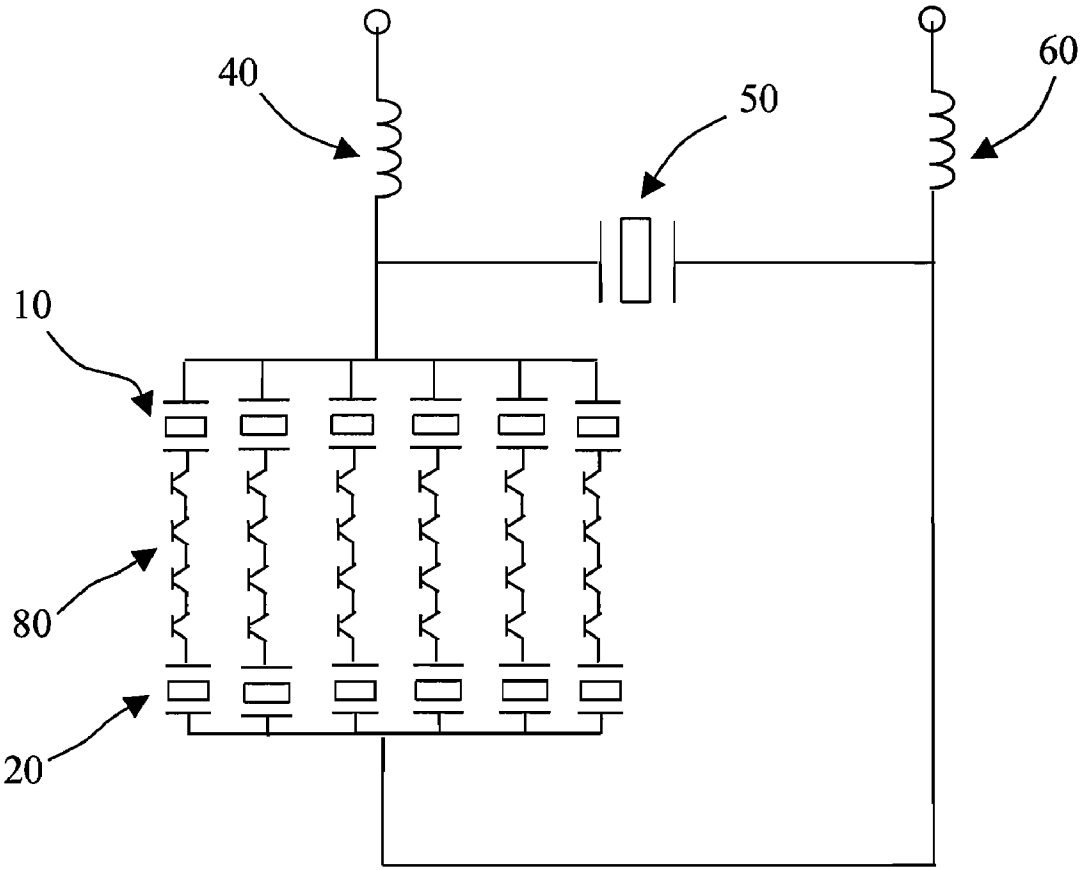
FIG. 6 is a diagram schematically showing the application of the present invention to LEDs.
Figure 7:
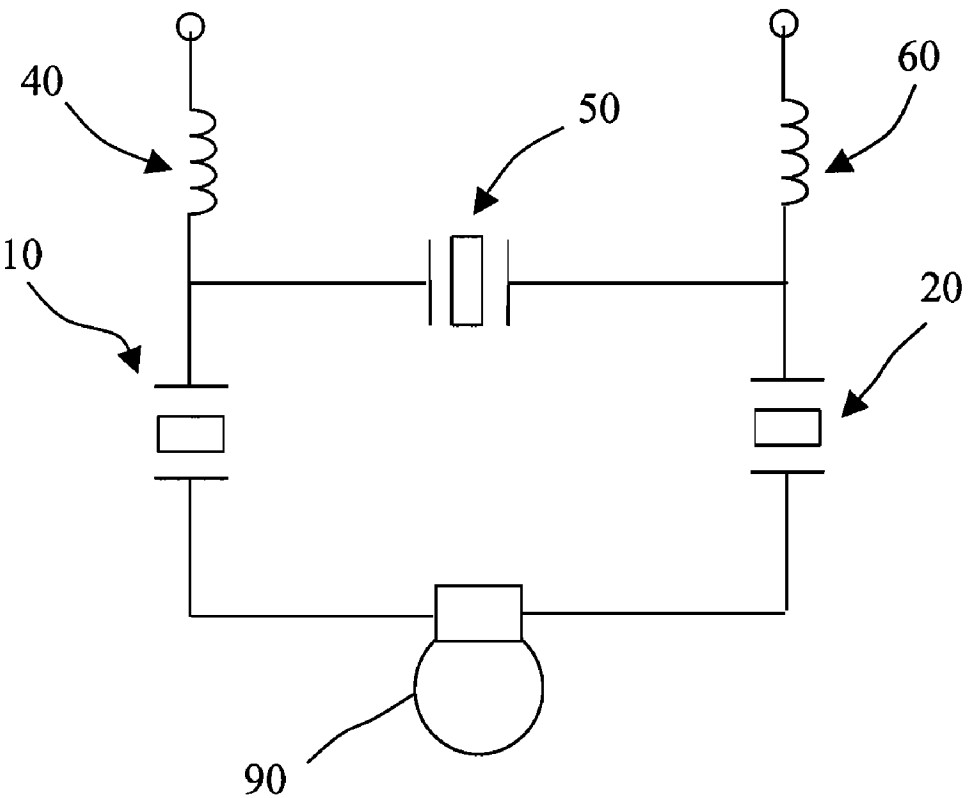
FIG. 7 is a diagram schematically showing the application of the present invention to a power saving light bulb.

The present invention applies to a single CCFL, a single EEFL (External Electrode Fluorescent Lamp), a single power saving light bulb, and a single LED (Light Emitting Diode). The present invention also applies to parallel CCFLs, parallel EEFLs, parallel power saving light bulbs, and parallel LEDs. Refer to from FIG. 5 to FIG. 7 diagrams respectively schematically showing the applications of the present invention to an EEFL 70, LEDs 80 and a power saving light bulb 90. Each of the lamp-ignition circuits shown in FIGS. 5-7 contains a full-bridge resonant circuit. However, the lamp-ignition circuit containing a half-bridge resonant circuit also applies to the abovementioned cases.

Figure 8:
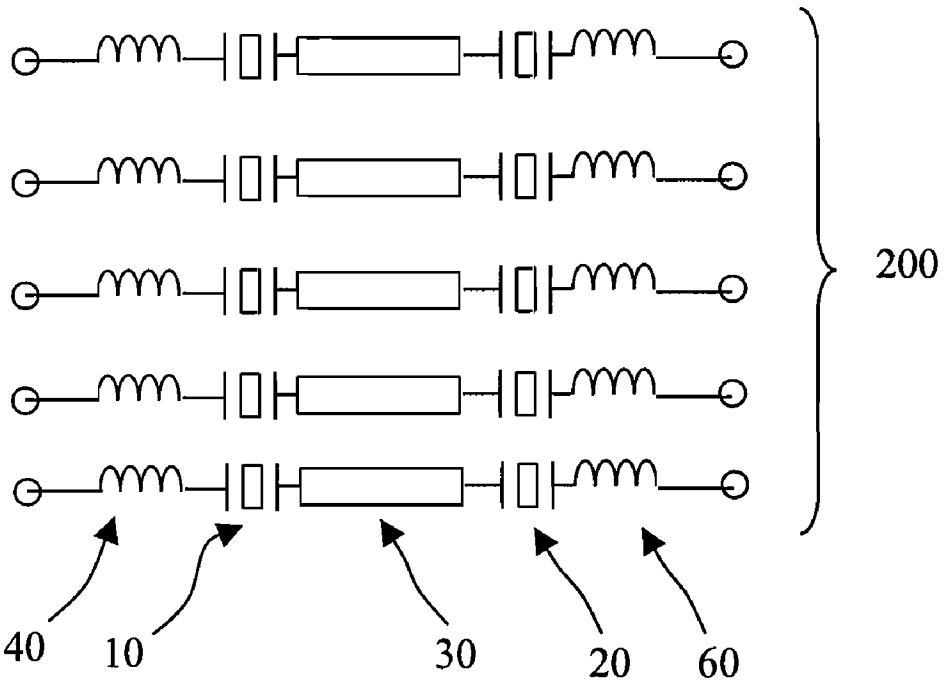
FIG. 8 is a diagram schematically showing another full-bridge piezoelectric cascade resonant lamp-ignition circuit according to one embodiment of the present invention.
Figure 9:
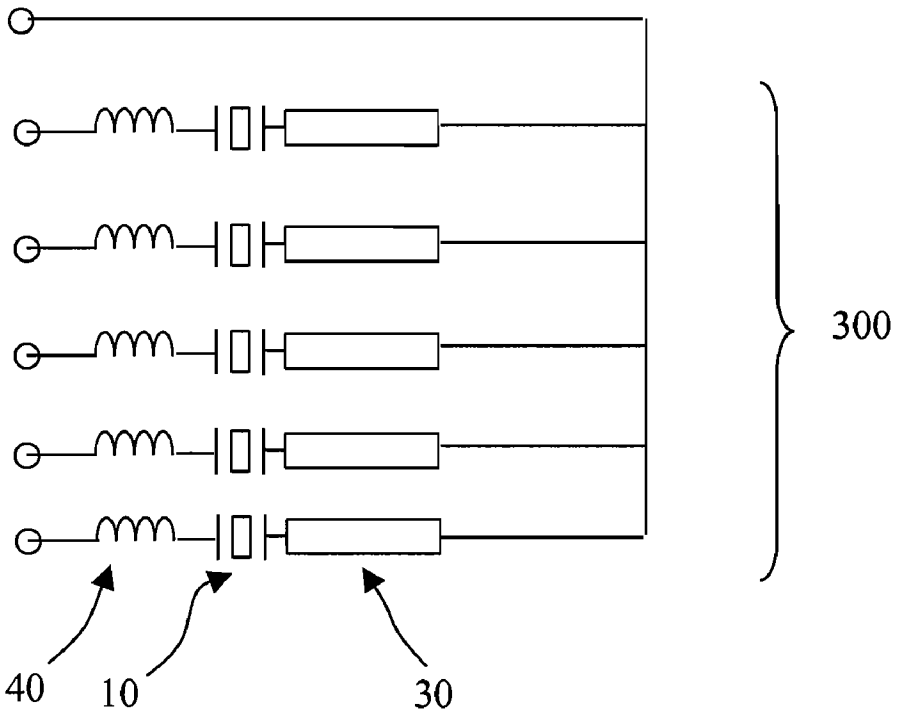
FIG. 9 is a diagram schematically showing a half-bridge piezoelectric cascade resonant lamp-ignition circuit according to one embodiment of the present invention.

The present invention also applies to a large size (such as over 42 in.) backlight plate. A large size backlight plate usually needs longer (such as over 1 m) lamps. However, long lamps have greater brightness difference caused by greater inner capacitance loss thereof. Thus, each long lamp needs independent resonant inductors and independent capacitors to balance capacitance. Refer to FIG. 8 and FIG. 9. In FIG. 8, a double high voltage (full-bridge) piezoelectric cascade resonant lamp-ignition circuit 200 is used to exemplify the application of the present invention to a large size backlight plate, and each lamp 30 is cascaded to two piezoelectric capacitors 10 and 20 and two resonant inductors 40 and 60. In FIG. 9, a single high voltage (half-bridge) piezoelectric cascade resonant lamp-ignition circuit 300 is used to exemplify the application of the present invention to a large size backlight plate, and each lamp 30 is cascaded to one piezoelectric capacitor 10 and one resonant inductor 40.

The embodiments described above are only to exemplify the present invention but not to limit the scope of the present invention. Therefore, any equivalent modification or variation according to the spirit of the present invention is to be also included within the scope of the present invention, which is based on the claims stated below.

What is claimed is:

1. A piezoelectric cascade resonant lamp-ignition circuit comprising at least one piezoelectric capacitor each cascaded to one of at least one lamp and each piezoelectric capacitor comprising a piezoelectric substrate and two conductive layers, wherein said piezoelectric substrate has an upper surface and a lower surface, and said two conductive layers are respectively formed on said upper surface and said lower surface of said piezoelectric substrate to function as two electrodes of each of said at least one piezoelectric capacitor; and at least one resonant inductor cascaded to said at least one piezoelectric capacitor.

2. The piezoelectric cascade resonant lamp-ignition circuit of claim 1 comprising two said piezoelectric capacitors and two said resonant inductors, wherein one of said at least one lamp is arranged in between and cascaded to two said piezoelectric capacitors, and a combination of said at least one lamp and two said piezoelectric capacitors is arranged in between and cascaded to two said resonant inductors.

3. The piezoelectric cascade resonant lamp-ignition circuit of claim 1, wherein said at least one lamp is a single CCFL (Cold Cathode Fluorescent Lamp), a single EEFL (External Electrode Fluorescent Lamp), a single power saving light bulb, or a set of LEDs (Light Emitting Diode).

4. The piezoelectric cascade resonant lamp-ignition circuit of claim 1, wherein said at least one lamp is a plurality of CCFLs, a plurality of EEFLs, a plurality of power saving light bulbs, or a plurality of sets of LEDs.

5. The piezoelectric cascade resonant lamp-ignition circuit of claim 4, wherein each of said at least one lamp is arranged in between and cascaded to two said piezoelectric capacitors.

6. The piezoelectric cascade resonant lamp-ignition circuit of claim 4, wherein each of said at least one lamp is arranged in between and cascaded to one said piezoelectric capacitor and one said resonant inductor.

7. The piezoelectric cascade resonant lamp-ignition circuit of claim 1 further comprising an auxiliary capacitor connected in parallel with said at least one piezoelectric capacitor and said at least one resonant inductor.

8. The piezoelectric cascade resonant lamp-ignition circuit of claim 1, wherein said piezoelectric substrate and said two conductive layers have a disc shape, and said two conductive layers are respectively formed on total or partial said upper surface and total or partial said lower surface of said piezoelectric substrate.

9. The piezoelectric cascade resonant lamp-ignition circuit of claim 1, wherein said two conductive layers are made of a silver paste, a copper paste or a nickel paste.

* * * * *